United States Patent [19]

Mills

[11] Patent Number: 4,852,896

[45] Date of Patent: Aug. 1, 1989

[54] GOLF EQUIPMENT CARRIER WITH ROTATING CLUB REDUCING FRAME

[76] Inventor: S. Dwight Mills, 2023 Eastview Dr., Sun City Center, Fla. 33570

[21] Appl. No.: 897,894

[22] Filed: Aug. 19, 1986

[51] Int. Cl.[4] ..... A63B 55/00; A63B 55/02

[52] U.S. Cl. ..... 280/47.18; 280/DIG. 6; 206/315.2; 206/315.3; 206/315.9; 206/315.6; 211/70.2; 224/919

[58] Field of Search ..... 280/DIG. 6, DIG. 5, 280/47.18, 646; 206/315.3, 315.4, 315.5, 315.6, 315.2, 315.7, 315.9, 315.8; 211/70.2; 224/919, 274; 273/32 D, 32 E

[56] References Cited

U.S. PATENT DOCUMENTS

| | | | |
|---|---|---|---|
| 699,391 | 5/1902 | Johnson | 211/70.2 |
| 1,418,093 | 5/1922 | Parmater | 280/DIG. 6 |
| 1,570,500 | 1/1926 | Kennedy . | |
| 2,763,309 | 9/1956 | Jones | 206/315.6 |
| 2,806,711 | 9/1957 | Jacobs | 280/DIG. 6 |
| 2,881,925 | 4/1959 | Idoux | 280/DIG. 6 |
| 2,890,061 | 6/1959 | Watson | 280/DIG. 6 |
| 3,014,595 | 12/1961 | Bartmann | 280/DIG. 6 |
| 3,425,708 | 2/1969 | Sato | 280/DIG. 6 |
| 3,460,597 | 8/1969 | Daly | 206/315.4 |
| 4,029,136 | 6/1977 | Jacoby | 206/315.6 |
| 4,111,248 | 9/1978 | Leichhardt | 206/315.6 |
| 4,181,167 | 1/1980 | Ret | 206/315.6 |
| 4,245,684 | 1/1981 | Street et al. | 206/315.6 |
| 4,522,300 | 6/1985 | Hamblet | 206/315.4 |
| 4,753,446 | 6/1988 | Mills | 206/315.6 X |

*Primary Examiner*—Sue A. Weaver

*Attorney, Agent, or Firm*—Biebel, French & Nauman

[57] ABSTRACT

A golf equipment carrier is disclosed wherein golf clubs are supported upon an elongated club receiving frame which is supported for rotation upon a base member from which a club protecting cover extends vertically upwardly about the club receiving frame and includes an opening extending from the top of the cover downwardly a substantial distance such that clubs can be inserted and withdrawn from the club receiving frame laterally through the cover. The carrier may be conventiently secured to a powered golf cart which carries golfers as well as golfing equipment by means of a clamp which is secured to the carrier, and may also be configured as a manual golf cart by means of a detachable handle and detachable wheels.

8 Claims, 6 Drawing Sheets

GOLF EQUIPMENT CARRIER WITH ROTATING CLUB REDUCING FRAME

BACKGROUND OF THE INVENTION

The present invention relates generally to the game of golf, and more particularly, to a carrier for supporting golf clubs, balls, tees and other associated golfing equipment for convenient access and transport as a golfer travels around a golf course.

Golf clubs and associated golfing equipment are typically carried in a golf bag which may be slung over a golfer's shoulder and carried about a course during a round of golf. Since fully equipped golf bags are quite heavy due to a large number of clubs and a variety of spare balls and other equipment which are carried by the bag, alternatives to personally carrying the bag are sought after. Such alternatives include caddies, which are expensive and typically not available or, more commonly, golf carts, which may be powered for also carrying the golfer or manual for only supporting the golf bag, with the manual cart being pulled by the golfer.

Manual golf carts may add considerable additional weight to the golf bag. Also, the golf bag must be strapped to the golf cart, and with the limited size of the storage space available in popular smaller sized cars, may have to be removed for transportation to and from the golf course. Powered golf carts can be designed such that golf bags are simply layed into a relatively stable supporting position on a cart. However, it is desirable to also strap golf bags into powered carts due to the possibly severe bouncing and jostling which can occur as a powered cart is driven about a golf course, oftentimes onto portions other than the fairway.

In addition to transportation problems, conventional golf bags may also result in damage to the golf clubs. The gripping handles of golf clubs, which are typically wrapped with leather or other readily gripped material, can be damaged when they are jammed downwardly into a conventional golf bag. Access to the clubs can also be a problem when conventional golf bags are used on a powered golf cart since they must clear the top of the bag which may be elevated sometimes a substantial distance off the ground by the bag supporting portion of the powered cart.

It is thus apparent that an improved carrier for golf clubs and associated equipment, which provides improved access to the golf clubs, particularly when the carrier is supported upon a powered golf cart, would be appreciated by golfers who are faced with the alternative of cumbersome and heavy conventional golf bags. Such an improved golf equipment carrier is particularly desirable when it offers the potential for less weight, lower cost and serves to expand the options available to golfers who are looking for more convenient ways of pursuing their golf game.

SUMMARY OF THE INVENTION

It is a primary object of the present invention to provide an improved golf equipment carrier wherein golf clubs are supported upon an elongated club receiving frame which is supported for rotation upon a base member from which a club protecting cover extends vertically upwardly about the club receiving frame and includes an opening extending from the top of the cover downwardly a substantial distance such that clubs can be inserted into and withdrawn from the club receiving frame laterally through the cover.

According to one aspect of the present invention, an improved golf equipment carrier comprises a bottom member having a plurality of upwardly directed socket means distributed thereabout for receiving the ends of inverted club shafts. A top member has a corresponding plurality of club engaging means for receiving and retaining shank portions of the club shafts. The bottom and top members are centrally interconnected by connecting means which serve to space the top and bottom members from one another and to form the top and bottom members into a vertically elongated club receiving frame. Base means are provided for supporting the club receiving frame for rotation about a generally vertical axis and cover means extending upwardly from the base means at least to the top member provides for protecting clubs supported on the club receiving frame. The cover means includes an opening therein extending from the top thereof downwardly a substantial distance toward the bottom member whereby clubs can be inserted into and withdrawn from the club receiving frame laterally through the cover means.

While the various clubs supported upon the elongated club receiving frame are positioned around the frame, they can be easily moved into a position adjacent to the opening through the cover by rotating the club receiving frame upon the base such that any club can be conveniently and easily removed or inserted laterally through the cover means. The connecting means may comprise a tubular member open above the top member for receiving a ball retriever, additional club, umbrella or other elongated piece of golf equipment. The tubular member preferably extends above the top member such that one or more ball holders may be secured to the tubular member above the top member. Golf tees may be conveniently received within aperture means formed into the top member of the golf equipment carrier.

To ensure stability and long life for the rotatable elongated club receiving frame, the golf equipment carrier preferably further comprises positioning means for supporting and centering the top member of the frame. The positioning means may comprise a platform recessed within and supported upon an upper end of the cover means and being coextensive therewith and a plurality of axial extensions projecting from the top member and being sized such that they slidingly engage an inner surface of the cover means and bear upon the platform. Preferably, the axial extensions comprise rods capped by closed-end tubular members of material which forms a bearing engagement with the cover means and the platform. The club engaging means of the top member preferably comprise a plurality of spaced resilient clips sized to receive and retain shank portions of the club shafts.

To facilitate the game of a user of the golf equipment carrier of the present invention, holder means may be secured to an outer surface of the cover means for retaining a putter therein such that the putter, which is used on almost every hole, is readily available to the golfer without rotating the club receiving frame of the carrier. The golf equipment carrier of the present invention is particularly applicable for use on a powered golf cart yet may be readily converted to a manual golf cart. To this end, the golf equipment carrier of the present invention further comprises clamp means for securing the carrier to a powered golf cart and also a detachable handle and wheels are provided for converting the golf equipment carrier to a manual golf cart which may be pulled by the golfer. To ensure that golf clubs are not inadvertently dislodged from the club receiving frame and potentially lost through the opening in the cover, a retainer member is preferably attached to the cover for movable extension across the opening such that the member can be placed across the opening for retention of the golf clubs, but moved to clear the opening to allow insertion and/or withdrawal of a club.

The golf equipment carrier of the present application may additionally comprise shaft retaining means secured to the connecting means intermediate the top member and the bottom member for engaging club shafts inserted into the vertically elongated club receiving frame to thereby resist the tendency of the clubs to turn in the frame. When shaft retaining means are provided, the top member preferably comprises a generally circular member wherein the club engaging means comprises a plurality of slots extending radially thereinto, with each of the slots terminating in a club receiving pocket extending from its corresponding slot and separated therefrom by a shaft retaining notch. In accordance with this embodiment of the top member, the end of the club shaft can be inserted into one of the socket means with the shank portion of the shaft then being inserted into a corresponding one of the slots such that it engages the retaining means as it is forced beyond the shaft retaining notch and moved into the corresponding club receiving pocket.

Other objects and advantages of the invention will be apparent from the following description, the accompanying drawings and the appended claims.

DETAILED DESCRIPTION OF THE INVENTION

Figure 1:
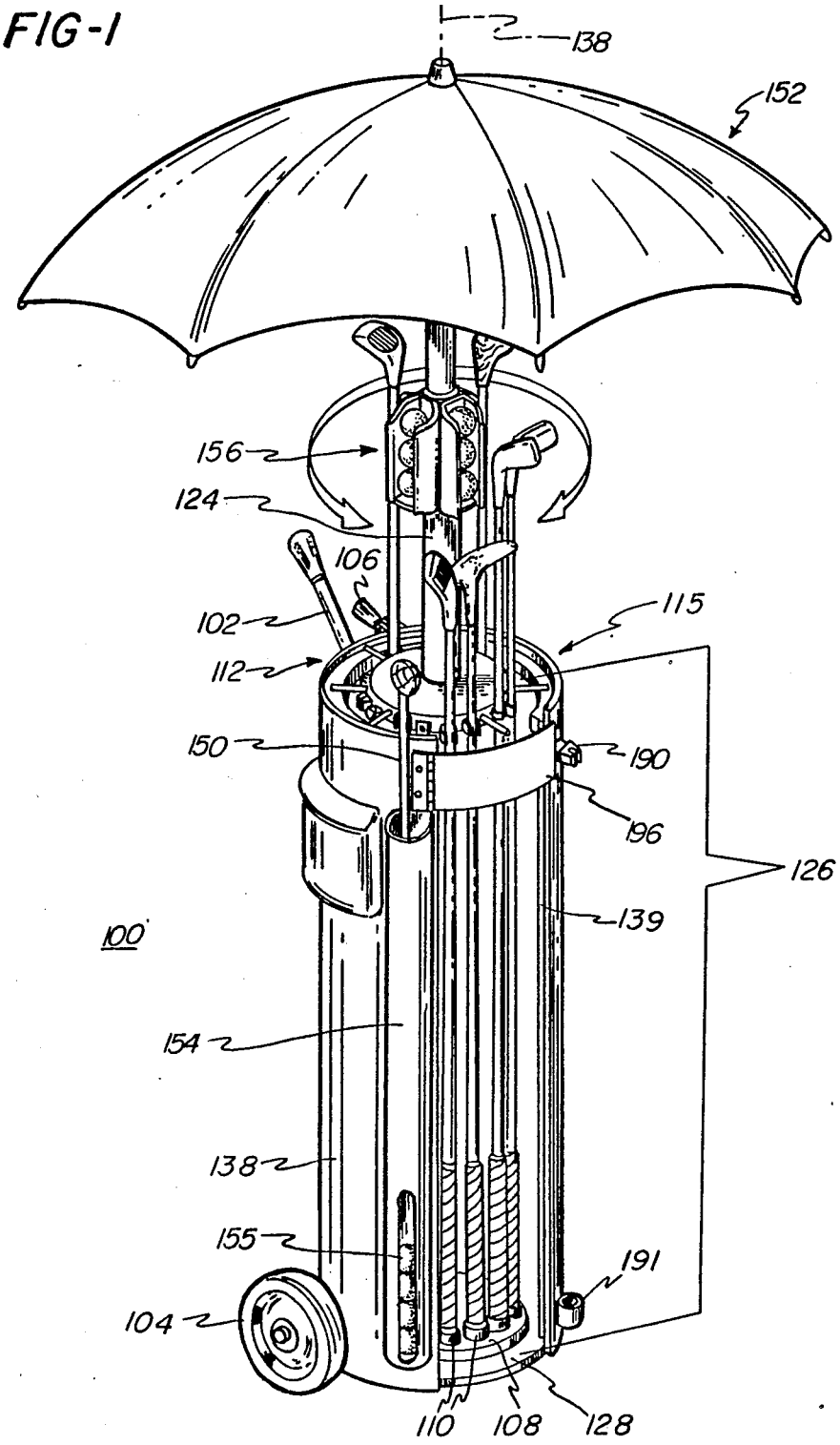
FIG. 1 is a perspective view of a golf equipment carrier in accordance with the present invention.
Figure 11:
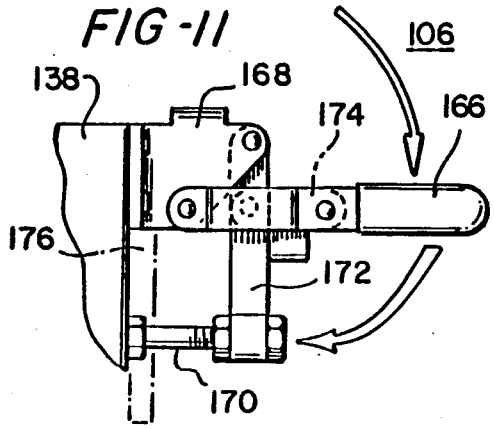
FIGS. 10 and 11 show a clamp which is secured to the golf equipment carrier of the present invention for removably securing the carrier to a golf cart.
Figure 10:
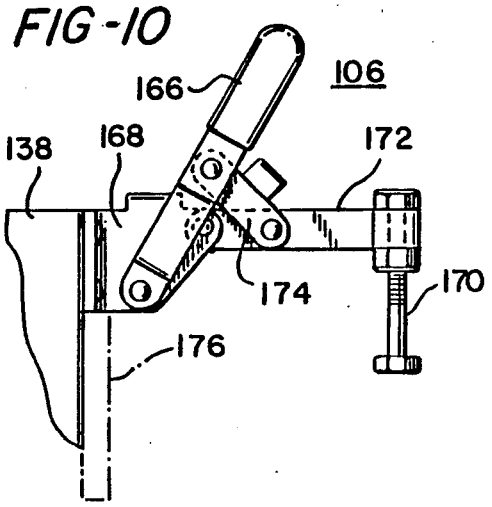
Figure 12:
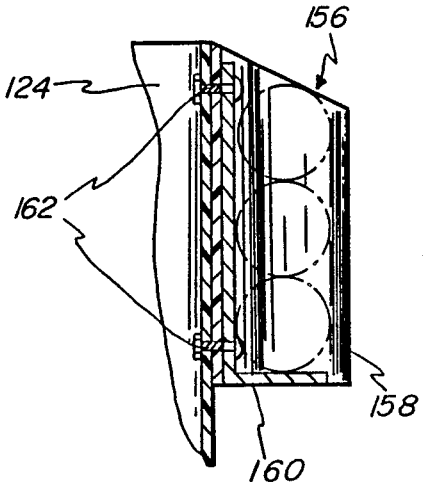
FIG. 12 is a sectional side view of a ball holder taken along the line 12—12 of FIG. 3.

FIG. 1 is a perspective view of a golf equipment carrier 100 in accordance with the present invention. As shown in FIG. 1, the golf equipment carrier 100 is set up as a manual golf cart which can be pulled around a golf course by means of a handle 102 and wheels 104 which are detachably secured to the carrier 100. If a powered golf cart is to be used, the handle 102 and wheels 104 are removed from the carrier 100 and the carrier 100 is secured to the power cart by clamp means 106 which is best shown in FIGS. 10 and 11.

The golf equipment carrier 100 comprises a bottom member 108, as best shown in FIGS. 1, 2, 8 and 14, having a plurality of upwardly directed socket means comprising tubular members 110 in the illustrated embodiment. Fourteen tubular members 110 are evenly distributed about the bottom member 108 which is circular in the illustrative embodiment. It is noted, however, that any reasonable number of tubular members or other socket means could be utilized in the present invention and that a variety of bottom member shapes and distributions of the socket means thereabout are possible.

Figure 2:
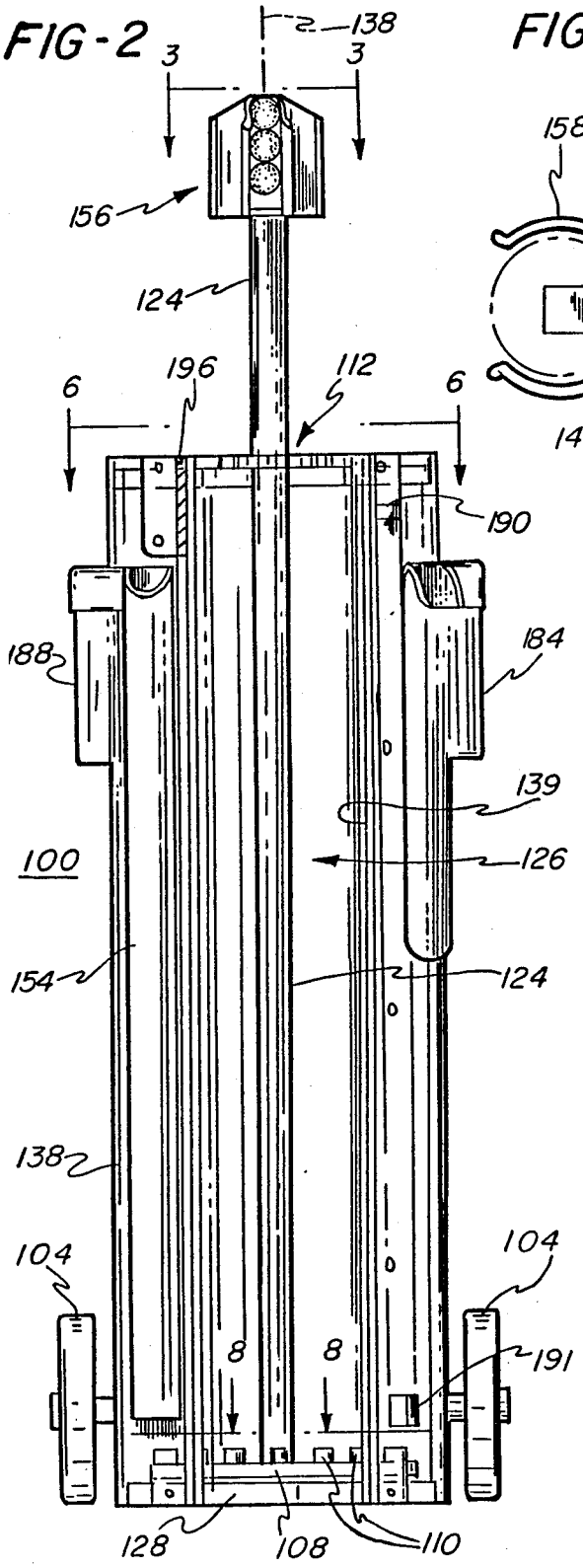
FIG. 2 is front view of the golf equipment carrier of the present invention with the golf clubs, umbrella and ball retriever removed.
Figure 3:
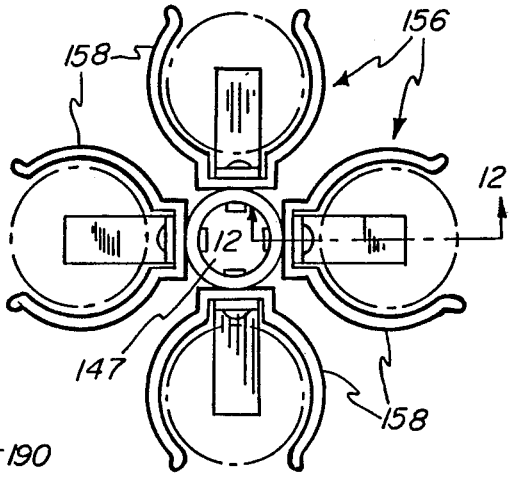
FIG. 3 is a plan view of the very top portion of the golf equipment carrier of FIG. 1 showing the tops of ball holders included on the carrier.
Figure 4:
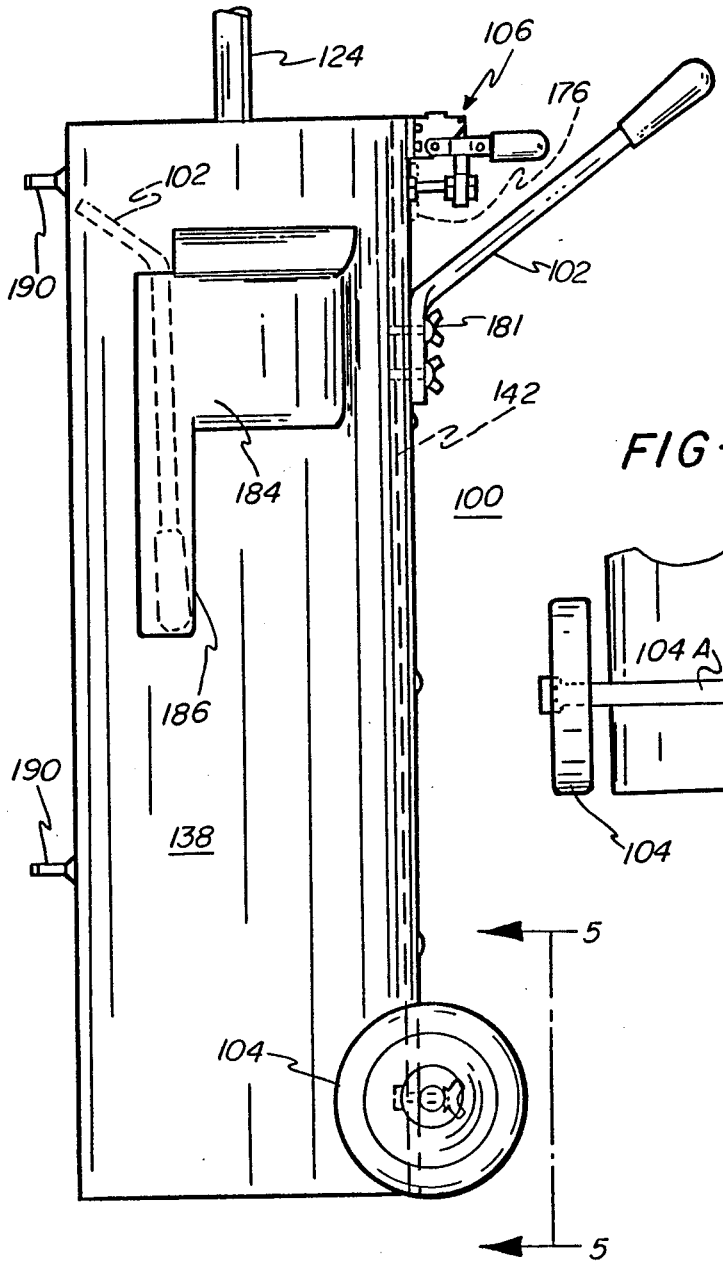
FIG. 4 is a side view of the golf equipment carrier of FIGS. 1 and 2.
Figure 5:
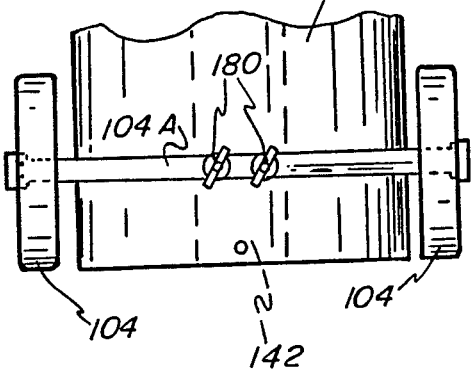
FIG. 5 shows the attachment of wheels to the base of the carrier to convert it to a manual golf cart.
Figure 6:
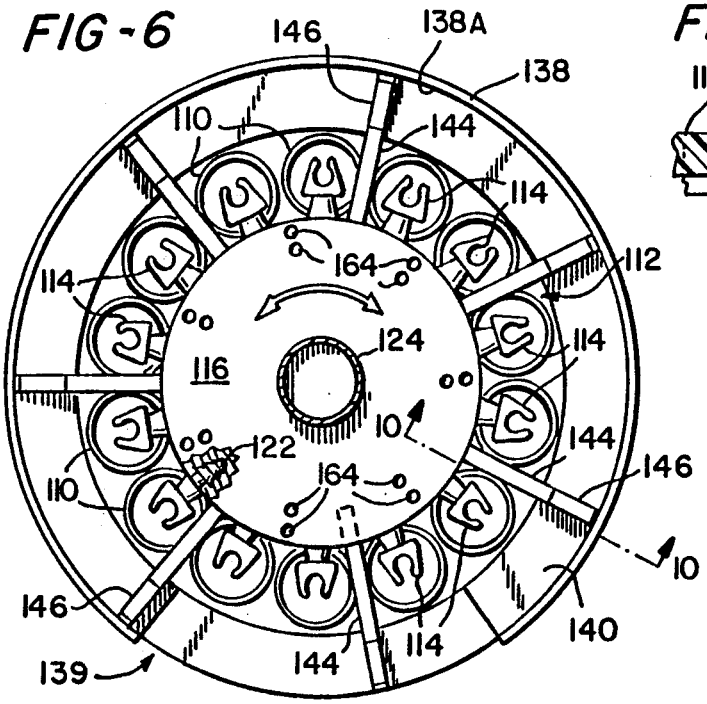
FIG. 6 is a sectional view taken along the section line 6—6 of FIG. 2 showing the top member and the upper end of the cover of the golf equipment carrier.
Figure 13:
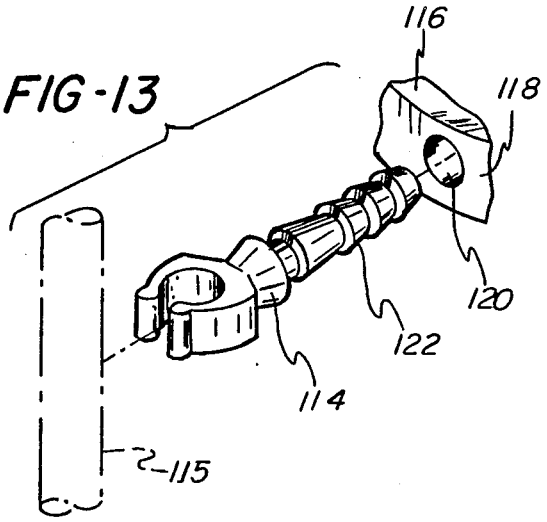
FIG. 13 shows a resilient clip used on the top member of a club receiving frame of the carrier for receiving and retaining shank portions of club shafts.

A top member 112, as best shown in FIGS. 1, 2 and 6, has a corresponding plurality of club engaging means which in the first illustrative embodiment comprise resilient clips 114 sized and distributed for receiving and retaining shank portions 115 of club shafts to be retained within the carrier 100. The top member 112 in the illustrative embodiment comprises a circular central member 116 defining an outer annular surface 118 into which 14 radially extending circular holes 120 are drilled or otherwise formed. The resilient clips 114 each include a toothed extension 122 which is forced into the hole 120 and frictionally engages the hole 120 to retain the clips 114 to the circular central member 116 of the top member 112 as shown in FIG. 13. Connecting means preferably comprising a tubular member 124 centrally interconnects the top member 112 and the bottom member 108, and provides for spacing the top and bottom members 112 and 108 from one another to form a vertically elongated club receiving frame 126.

Base means comprises a circular base plate 128 and a turntable 130 secured thereto. The turntable 130 defines a race 132 which is positioned opposite to a race 136 defined in the bottom member 108 of the elongated club receiving frame 126. Ballbearings 134 are received within the races 132 and 136 such that the club receiving frame 126 is mounted for rotation about a generally vertical axis 138 passing through the tubular member 124, see FIGS. 1 and 2. Cover means comprising a cover sleeve 138 extends between and is secured to the base plate 128 and a platform 140 for protecting clubs supported upon the club receiving frame 126. The cover 138 includes an opening 139 which extends from the top of the cover 138 at least a substantial distance toward the bottom member 108, and in the illustrative embodiment, all the way to the bottom of the cover 138. Accordingly, the cover is semicylindrical and the platform 140 which is recessed within an upper end of the cover sleeve 138 and coextensive therewith is semiannular. The cover sleeve 138 is also secured to vertical ribs 142 which extend between and are secured to the base plate 128 and the platform 140. The base plate 128, the vertical ribs 142, and the platform 140 thus constitute an outer frame means to which cover sleeve 138 is attached.

Figure 7:
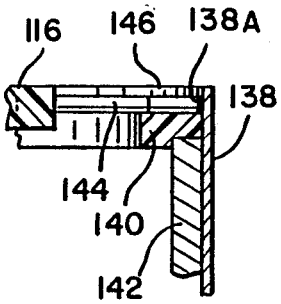
FIG. 7 is a sectional view taken along the section line 7—7 of FIG. 6.
Figure 8:
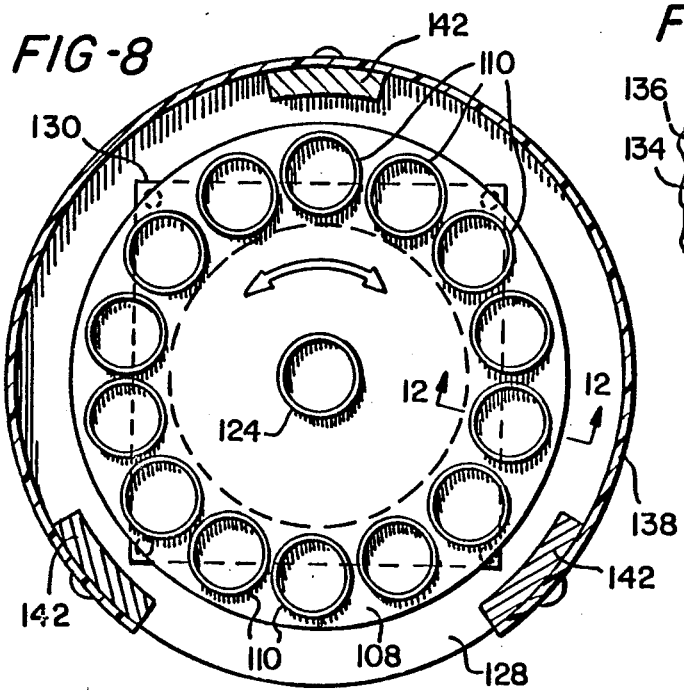
FIG. 8 is a sectional view taken along the section line 8—8 of FIG. 2 showing the bottom member and the bottom of the cover of the golf equipment carrier.
Figure 9:
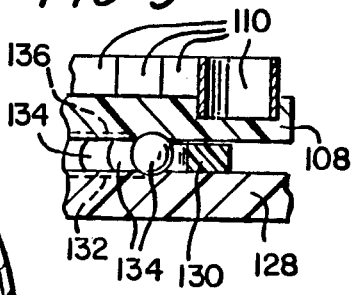
FIG. 9 is a sectional view taken along the section line 9—9 of FIG. 8.

As best shown in FIGS. 6 and 7, the sleeve 138 and platform 140 form the base of positioning means for supporting and centering the top member 112 of the elongated club receiving frame 126. The positioning means also comprises a plurality of axial extensions 144 extending from the circular central member 116. The axial extensions 144 are sized such that they slidingly engage an inner surface 138A of the cover 138 and bear upon the platform 140. The extensions 144 preferably comprise aluminum rods having the distal ends covered by closed-end tubular members 146 which are formed of a material, such as tetraflouroethylene or nylon, which presents a reduced friction bearing engagement with the cover 138 and the platform 140.

The tubular member 124 preferably extends above the top member 112 and presents an open end 147 for receiving a ball retriever 150, an additional club, an umbrella 152 or other elongated piece of golf equipment. As shown in FIG. 1, the umbrella 152 has been opened and inserted into the upper open end 147 of the tubular member 124 such that it provides protection for the clubs and other golf equipment supported upon the carrier 100 during a rain shower. The ball retriever 150 has been inserted into the pocket 154 which normally receives the umbrella 152 when it is not deployed as shown in FIG. 1, but collapsed and stored during the hopefully typical sunny golf outing. In that event, the ball retriever 150 is inserted into the upper open end 147 of the tubular member 124 where it can be conveniently stored yet readily withdrawn if needed. The pocket 154 may include an opening 155 in its lower end such that balls can be stored therein in lieu of or in addition to the umbrella 152 or the ball retriever 150.

By extending the tubular member 124 above the top member 112, a pedestal is formed for positioning four ball holders 156 as shown in FIGS. 1, 2, 3 and 12. The ball holders 156 each comprise an open semicylindrical sleeve 158 which is angled on the top and flat on the bottom, with the sleeves surrounding and being secured to the tubular member 124 by means of generally L-shaped brackets 160 preferably formed of a rust-resistant metal which are secured to the tubular member 124 through the back of the semicylindrical sleeve 158 by means of screws 162 or otherwise. In the illustrated embodiment, each of the ball holders 156 can hold three balls such that a total of 12 balls can be stored in the ball holders 156. Of course, alternate lengths or numbers of ball holders could be provided as desired in accordance with the present invention as should be apparent. Provision is made for supporting golf tees in the carrier 100 by means of apertures 164 formed into the circular central member 112.

The golf carrier 100 of the present invention is particularly adaptable for use on a powered golf cart by virtue of the clamp means 106 as best shown in FIGS. 10 and 11. The clamp means 106 comprises a main clamp frame 168 which is secured to the cover 138 and one of the vertical ribs 142 of the carrier 100, and a clamp handle 166 is pivotally mounted to the clamp main frame 168. An adjustable clamping member 170 is secured to an arm 172 which is also pivotally mounted to the clamp main frame 168. The clamping member 170 is moved from an open position shown in FIG. 10 to a closed position shown in FIG. 11 as the handle 166 is snapped into a locked position defined by a link 174 which pivotally interconnects the handle 166 and the arm 172 which supports the adjustable member 170. A frame member 176, which is commonly an arcuate metal channel on powered golf carts against which conventional golf bags are leaned, may be securely engaged by the clamp means 106 by operating the lever 166 downwardly into its locked position as shown in FIG. 11. The carrier 100 may be removed by moving the lever 166 upwardly to remove the adjustable clamping member 170 from engagement with the frame member 176 of the powered golf cart.

Alternately, as best shown in FIGS. 1, 2, 4 and 5, the wheels 104 may be secured to the golf carrier 100 by means of winged connectors 180 or the like. Similarly, the pull handle 102 may be connected to the carrier 100 by means of winged connectors 182 as shown. When not in use, the wheels 104 and associated axle 104A and the handle 102 can be stored, for example, in a pouch 184, including an elongated section 186 specifically for enclosing the handle 102 and the axle 104A. Other or alternate pouches, such as the pouch 188, can be included on the cover 138 for carrying additional golfing equipment.

A resilient clip 190 comparable to the clips 114 can be mounted toward the upper end of the outside of the cover 138 adjacent the opening 139, and a socket 191 comparable to the tubular members 110 can be mounted toward the lower end of the outside of the cover 138, as shown in FIGS. 1 and 2, such that a putter can be engaged therein during a round of golf. In this way, the putter which is used on almost every hole will be readily available to the golfer utilizing the carrier 100. A retainer 196 is preferably provided and may, for example, be hingedly attached to the cover 138 across the opening 139, such that it is readily movable to allow insertion and/or withdrawal of a club from the carrier 100. The retainer 196 thus prevents clubs from being inadvertently dislodged from the elongated club receiving frame 126 and falling from the carrier 100. The retainer 196 can include a designation of the owner as suggested in FIG. 1 and can be movably mounted to the carrier 100 by other than hinge means as will be apparent to those skilled in the art.

In view of the above description, it is apparent that the vertically elongated club receiving frame 126 can be rotated to position any club within the opening 139 in the cover 138 such that it can be inserted or withdrawn from the carrier 100. Rotation of the elongated club receiving frame 126 can be conveniently effected, for example, by grasping the tubular member 124 or one of the axial extensions 144, for example the extension 144 which extends into the opening 139 of the cover 138.

Figure 14:
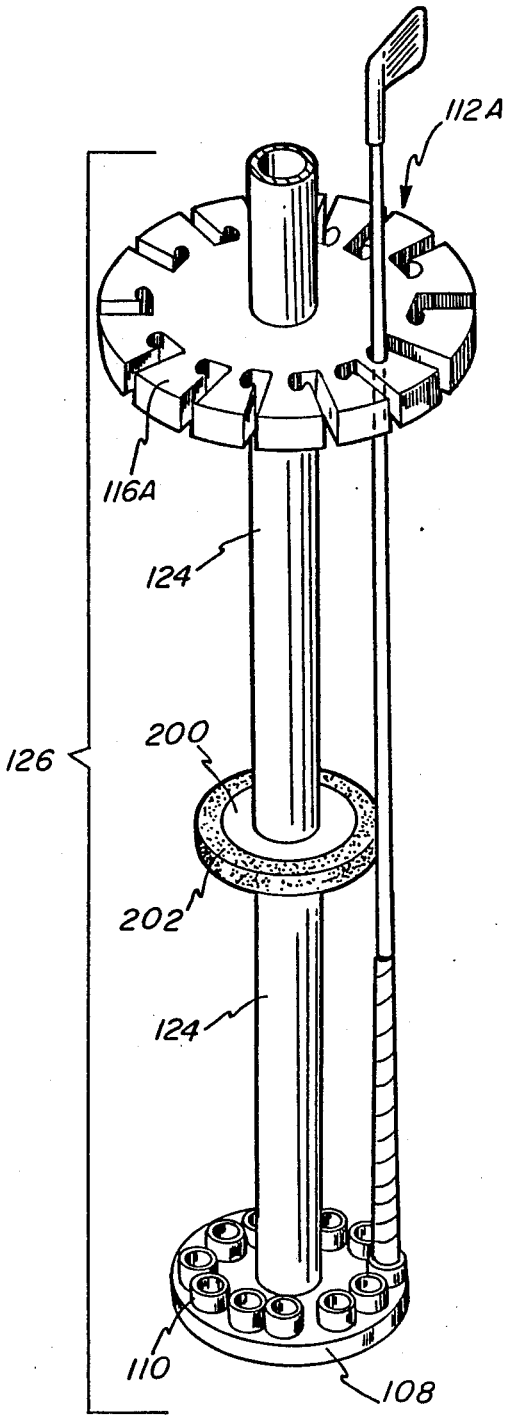
FIGS. 14–16 show an alternate embodiment of a club receiving frame for the golf equipment carrier of the present invention.
Figure 15:
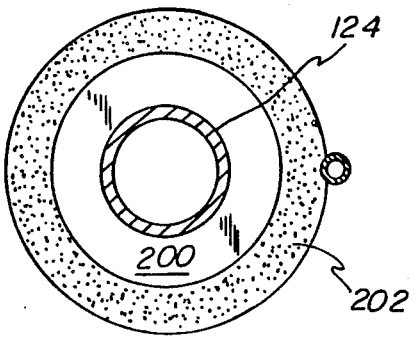
Figure 16:
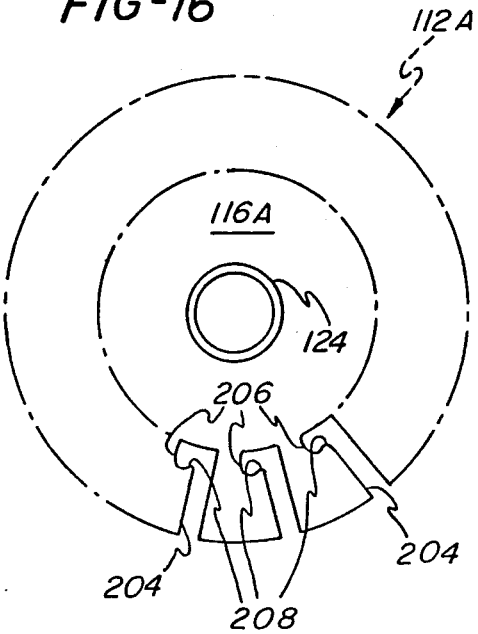

An alternate embodiment of the vertically elongated club receiving frame 126, which may be preferred particularly when the golf equipment carrier 100 is to be used on very rough terrain, is shown in FIGS. 14–16. In this embodiment, the vertically elongated club receiving frame 126 includes shaft retaining means comprising a disc 200, constructed for example from polypropylene, having an outer annular club shaft engaging layer 202 made of rubber or other resilient material. The disc 200 is secured to the tubular member 124 intermediate the bottom member 108 and a top member 112A such that its outer layer 202 engages club shafts supported on the frame 126.

The top member 112A of the embodiment shown in FIGS. 14 and 16 comprises an expanded circular central member 116A including alternate club engaging means which comprise a plurality of slots 204 extending radially inwardly from the outer surface of the expanded circular central member 116A. Each of the slots 204 terminates in a club receiving pocket 206 which extends generally perpendicularly from its corresponding slot 204 and is separated therefrom by a shaft retaining notch 208. While the shaft retaining means may be utilized with the previously disclosed top member 112, the top member 112A as shown in FIGS. 14 and 16 may be preferred due to its positive shaft retaining design.

In any event, in accordance with the alternate embodiment of the club receiving frame 126 shown in FIG. 14, a club is inserted laterally through the cover 138 of the carrier 100, with its end being fitted into a selected one of the tubular members 110. The shank portion of the club shaft is then inserted into a corresponding one of the slots 204 of the circular central member 116A. The club shaft is forced against the shaft retaining means to a point beyond the shaft retaining notch 208 by compression of the outer layer 202 on the disc 200. The club shaft is then moved into the corresponding club receiving pocket 206 and retained therein by the notch 208 and the outward force exerted by the compressed outer layer 202 on the disc 200 of the club retaining means. The force exerted by the club retaining means is sufficient to firmly hold the clubs on the frame 126 and substantially prevent rotation of the clubs when supported on the carrier 100. This embodiment of the club receiving frame 126 provides extended life, accommodates any diameter club shafts, and, by firmly holding the clubs against rotation, prevents potentially damaging jostling of the club heads.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A golf equipment carrier comprising:

a circular bottom member having a plurality of upwardly directed socket means distributed thereabout for receiving the handle ends of inverted club shafts;

a circular top member having a corresponding plurality of outwardly opening club engaging means for receiving and retaining shank portions of the club shafts;

a tubular member centrally interconnecting said top and bottom members and spacing said top and bottom members from one another and aligning said engaging means and said socket means thereby forming a vertically elongated club receiving frame, said tubular member extending above said top member and having an open upper end for receiving a ball retriever, additional club, umbrella or other elongated piece of golf equipment;

ball holder means spaced above the top member and attached to and surrounding the tubular member, so that a ball may be accessed therefrom at a plurality of circumferential positions on the tubular member;

ball holder means spaced above the top member and attached to and surrounding the tubular member, so that a ball may be accessed therefrom at a plurality of circumferential positions on the tubular member;

base means for supporting said club receiving frame for rotation thereon about a generally vertical axis; and outer frame means including a plurality of vertical ribs extending upwardly from said base means at least to said top member, a platform member attached to said vertical ribs and cooperating with a portion of said top member to restrain lateral movement of said club receiving frame within said outer frame means, said outer frame means including cover means for protecting clubs supported on said club receiving frame, said outer frame means having an opening therein extending from the top thereof downwardly a substantial distance toward said bottom member whereby clubs can be inserted into and withdrawn from said club receiving frame laterally through said outer frame means.

2. A golf equipment carrier as claimed in claim 1 wherein said top member comprises aperture means for receiving a plurality of golf tees therein.

3. A golf equipment carrier as claimed in claim 1 wherein said platform constitutes an upper end of said outer frame means and is coextensive therewith, and a plurality of axial extensions projecting from said top member, said axial extensions being sized such that they move along and bear upon said platform.

4. A golf equipment carrier as claimed in claim 3 wherein said axial extensions are rods capped by closed-end tubular members of material which forms a bearing alignment with said platform.

5. A golf equipment carrier as claimed in claim 1 further comprising holder means secured to an outer surface of said outer frame means for retaining a putter therein for ready access during use of said golf equipment carrier.

6. A golf equipment carrier as claimed in claim 1 further comprising clamp means on said outer frame means for securing said golf equipment carrier to a power golf cart.

7. A golf equipment carrier as claimed in claim 1 further comprising a detachable handle and wheels attachable to said outer frame means for converting said golf equipment carrier to a manual golf cart which may be pulled by a golfer.

8. A golf equipment carrier as claimed in claim 1 further comprising a retainer member attached to said platform and movable to allow insertion and/or withdrawal of a club through said opening in said outer frame means.

* * * * *

UNITED STATES PATENT AND TRADEMARK OFFICE

CERTIFICATE OF CORRECTION

PATENT NO. : 4,852,896

DATED : August 1, 1989

INVENTOR(S) : S. Dwight Mills

It is certified that error appears in the above-identified patent and that said Letters Patent is hereby corrected as shown below:

Page 1, Title: "REDUCING FRAME" should read --RECEIVING FRAME--

Page 1, "8 Claims, 6 Drawing Sheets" should read --8 Claims, 7 Drawing Sheets--

Col. 8, Delete lines 3 through 7.

Signed and Sealed this

Twenty-ninth Day of May, 1990

*Attest:*

HARRY F. MANBECK, JR.

*Attesting Officer*

*Commissioner of Patents and Trademarks*